US006170936B1

(12) United States Patent
Ahne et al.

(10) Patent No.: US 6,170,936 B1
(45) Date of Patent: Jan. 9, 2001

(54) SUBSTRATE HEATER CIRCUIT TOPOLOGY FOR INKJET PRINTHEAD

(75) Inventors: Adam Jude Ahne; Brian Keith Owens, both of Lexington, KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/359,878

(22) Filed: Jul. 23, 1999

(51) Int. Cl.[7] ..... B41J 2/05
(52) U.S. Cl. ..... 347/57; 347/60
(58) Field of Search ..... 347/17, 48, 62, 347/63, 13, 64, 65, 60, 56, 54, 57, 58, 59

(56) References Cited

U.S. PATENT DOCUMENTS

| | | | | |
|---|---|---|---|---|
| 4,125,845 | | 11/1978 | Stevenson, Jr. . | |
| 4,704,620 | | 11/1987 | Ichihashi et al. | 347/17 |
| 4,791,435 | | 12/1988 | Smith et al. | 347/18 |
| 4,910,528 | | 3/1990 | Firl et al. | 347/17 |
| 5,107,276 | | 4/1992 | Kneezel et al. | 347/17 |
| 5,144,336 | | 9/1992 | Yeung | 347/60 |
| 5,172,134 | * | 12/1992 | Kishida et al. | 347/13 |
| 5,175,565 | * | 12/1992 | Ishinaga et al. | 347/67 |
| 5,235,346 | | 8/1993 | Yeung | 347/209 |
| 5,291,215 | | 3/1994 | Nozawa et al. | 347/18 |
| 5,307,093 | | 4/1994 | Suzuki et al. | 347/17 |
| 5,331,340 | | 7/1994 | Sukigara | 347/14 |
| 5,512,924 | | 4/1996 | Takada et al. | 347/18 |
| 5,736,995 | | 4/1998 | Bohorquez et al. | 347/14 |
| 5,745,130 | | 4/1998 | Becerra et al. | 347/17 |
| 5,745,132 | | 4/1998 | Hirabayashi et al. | 347/17 |
| 5,815,180 | | 9/1998 | Barbour et al. | 347/59 |

* cited by examiner

*Primary Examiner*—David F. Yockey
*Assistant Examiner*—Juanita Stephens
(74) *Attorney, Agent, or Firm*—Michael T. Sanderson; Ludeka, Neely & Graham

(57) ABSTRACT

An inkjet printhead having a plurality of ink discharge nozzles that are served by respective ink supply conduits formed within a composite substrate includes ink discharge heaters respective to each of the nozzles, one or more substrate heaters for preheating an ink flow within the supply conduits and a plurality of resistors for monitoring the printhead quality during manufacture. The ink discharge heaters are in circuit with a first energy source connection and a common ground connection. The quality monitoring resistors are in series circuit with a second energy source connection and the common ground connection respective to the ink discharge heaters. At least one substrate heater is in circuit with a third energy source connection and the second energy source connection which, when the printhead is operatively connected for printing, is connected to ground.

15 Claims, 2 Drawing Sheets

SUBSTRATE HEATER CIRCUIT TOPOLOGY FOR INKJET PRINTHEAD

FIELD OF THE INVENTION

This invention relates to thermal ink jet printing devices. More particularly, the invention relates to an improved printhead and method of manufacturing the improved printhead.

BACKGROUND OF THE INVENTION

Thermal inkjet printing may be briefly described as an ink-drop on demand type of printing which uses thermal energy to produce a vapor bubble in an ink-filled channel. Each printhead supports a nozzle plate that is perforated with a large number of nozzle orifices distributed over a precise geometric pattern. Each orifice is served by a respective ink supply channel. Each of these respective ink supply channels is served by a rapidly responding electrical heating element such as a resistor located in the channel near the respective nozzle. These heating elements are individually charged by specifically addressed electrical pulses to momentarily vaporize a small quantity of ink in the channel. The abrupt phase change of the ink from liquid to vapor results in an abrupt volume increase in the proximity of the heater. This resulting vapor volume is characterized as a bubble. This sudden volumetric expansion of a bubble within the closed confines of the supply channel is accommodated toward the nozzle orifice by displacement of a droplet quantity of liquid ink from the nozzle orifice as a bulge of liquid that is held by surface tension to the liquid column behind it and to the nozzle face.

As the vapor cools and condenses, the bubble collapses. The segment of ink within the nozzle channel between the collapsing bubble and the liquid bulge reverses flow direction to fill the volumetric void. This flow direction reversal of ink mass causes a concentration of tensile stress between the ink mass at the inner end of the nozzle segment near the collapsing bubble and the accelerating mass of the ink bulge from the nozzle orifice thereby separating the bulge from the segment inner end as a droplet. This acceleration of the ink bulge mass out of the nozzle while the bubble volume is growing provides the velocity and momentum to carry the droplet in a substantially straight line toward an intended target medium such as a sheet of paper drawn over a platen.

Size of an ink droplet propelled from a nozzle orifice is largely determined by the temperature and viscosity characteristics of the ink. For print contrast consistency, some control over the ink temperature is asserted by means of one or more additional heating elements that are positioned in heat transfer association with the body of the printhead within which the ink flow channels are formed. This body is a laminated composite of numerous substrates, each having a distinctive topology of nozzles, fluid flow channels, chemically deposited conductors, and solid state circuitry constituents. Integrated with this topology is a series of electrical resistors having an operational purpose only during the printhead manufacture for monitoring and testing the quality of production.

To achieve manufacturing efficiency, electrical connection terminals are minimized by imposing multiple utilities upon a single connection. One such example is a common ground connection for all nozzle channel heaters. Because of the great differential in power demand between the nozzle heaters and the substrate heaters, however, the substrate heaters preferably are electrically charged across a ground terminal separate from the nozzle heaters. In another example, the substrate heater circuit derives voltage source from a bus terminal that also serves the nozzle heaters. Again, however, because of the great power differential and the priority of uniform current flow and timing to the nozzle heaters, it is essential for the substrate heaters not to be energized while the nozzle heaters are operating. Consequently, the substrate heaters may be energized only when the printhead is in transition between print lines. Although an operable prior art compromise, it would be preferable to energize the substrate heater circuit independently of the nozzle heater circuits.

A prior art quality test circuit also may share the same ground terminal with the nozzle heaters. Moreover, test circuits of the prior art may be energized with an independent voltage connection terminal. On the other hand, the quality test circuit has no further function after verification of the finished printhead. Hence, the quality test circuit imposes no current load on the ground terminal common with the nozzle heaters during operation of the printhead. Furthermore, the voltage connection terminal remains unconnected, inactive and unused after final assembly of the printhead with the pen body.

It is an object of the present invention, therefore, to provide printhead substrate heaters with an independent power circuit and connections.

It is also an object of the invention to free the nozzle heater bus circuit from a need to also conduct electrical current to the substrate heaters.

A further object of the invention is to free the operation of printhead substrate heaters from dependence upon the operational status of the printhead nozzle heaters

SUMMARY OF THE INVENTION

These and other objects of the invention as will become apparent from the detailed description to follow hereafter, are served by an inkjet printhead having a ink discharge nozzles served with an ink supply by respective ink flow conduits formed within a composite substrate. The printhead includes first electric heater means corresponding to each of the nozzles for energizing ink discharges from each respective nozzle. The printhead also includes second electric heater means for preheating the ink in the conduits. First circuit means, including first voltage connector means and first ground connector means, provide operational voltage to the first heater means. Second circuit means, including second voltage connector means and the first ground connector means, provide operational voltage to a series of electrical test circuit resistors during quality testing of the printhead. Since the functional purpose of the test resistors is limited to verification of the substrate fabrication quality, the test resistors are not used during normal printhead printing operations. Thus, when the printhead is operative, the second voltage connector means are electrically grounded. Third circuit means, including third voltage connector means and the second voltage connector means, provide operational voltage to the second heater means.

In a preferred embodiment, the invention provides a printhead circuit topology that controls the substrate heater circuit for preheating ink in the nozzle feed channels independently of the inkjet nozzle firing heaters. The substrate heater circuit is connected to a manufacturing quality test circuit that has no utility following production quality verification. Correspondingly, the prior art substrate heater circuit is disconnected from the nozzle heater bus terminal. The external connection terminal that was used for the substrate heater circuit ground is connected according to the invention to a directly controlled voltage source. When the printhead is permanently installed in the pen body carrier, the production quality test circuit is -rounded at opposite circuit ends and thereby becomes the ground terminal for the substrate heater circuit. Accordingly, the substrate heater may be energized independently of the operational state of any nozzle firing heater.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
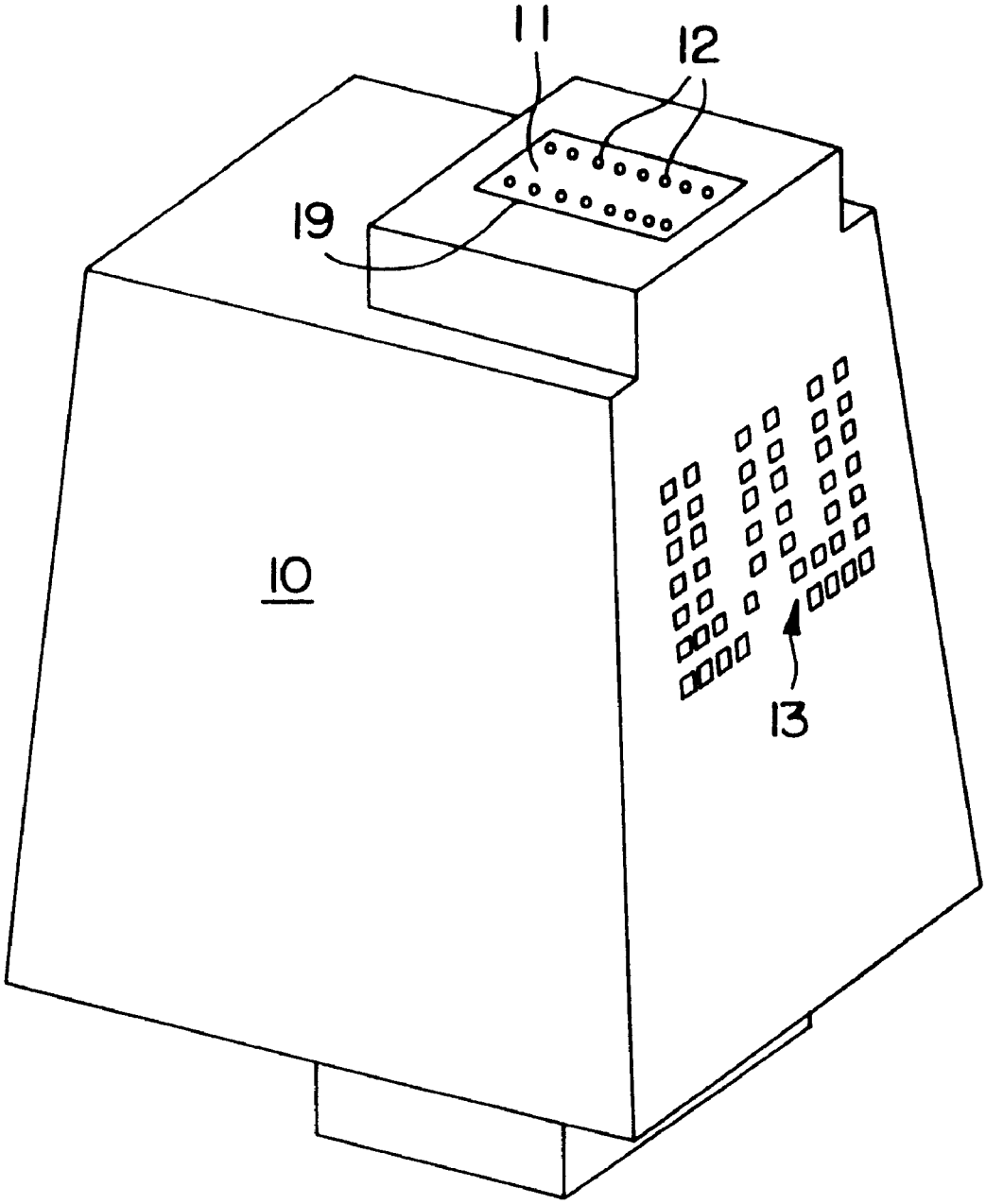
FIG. 1 is an isometric view of a pen body for an ink-jet printer.

Beginning with the prior art schematic of FIG. 1, an inkjet printer pen body 10 comprises an ink reservoir and a printhead 11. The printhead 11 is a complex composite of laminated substrates, each substrate having a distinctive topology of nozzles 12, fluid flow channels, chemically deposited conductors and solid state circuitry. To facilitate mass production, these fluid flow channels and circuits are located and placed at very carefully selected positions within the area and volume of the printhead. Conductive leads from circuits within the printhead are laid to the outer perimeter of the printhead for electrical contact continuity with corresponding power and signal leads that are carried by and across the pen body from pen body contacts 13. The printhead 11 is assembled with the pen body 10 by insertion of the printhead 10 into an open socket in the pen body surface. Electrical continuity across the physical interface 19 between cooperative pen body conductive leads and the printhead conductive leads is maintained by physical contact.

Figure 2:
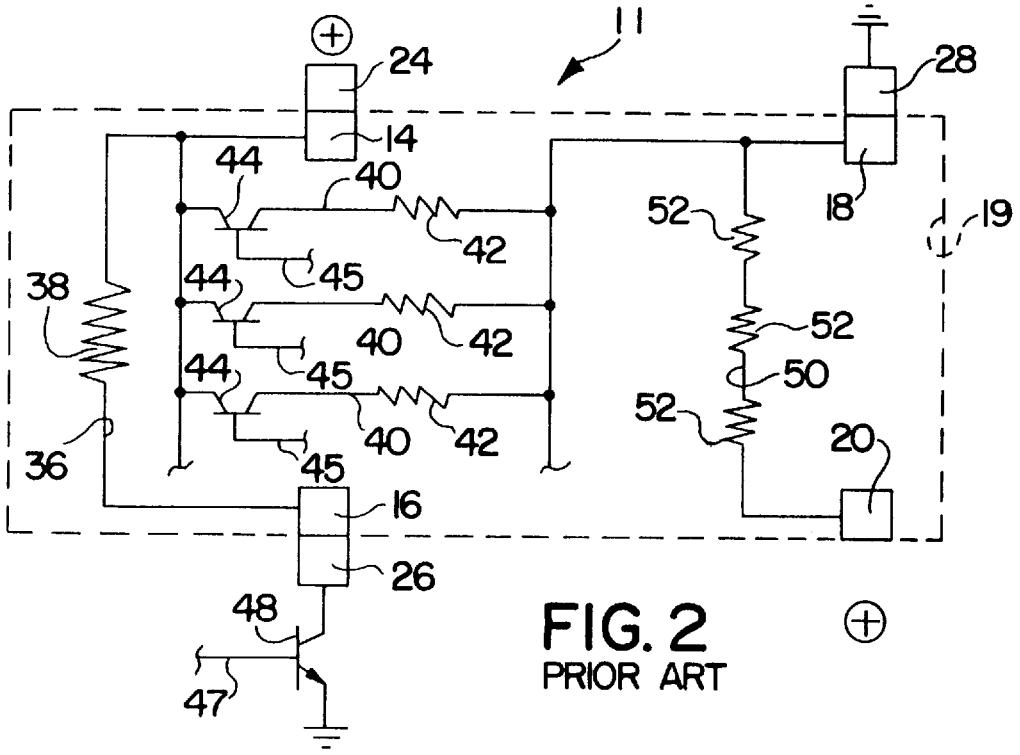
FIG. 2 PRIOR ART
FIG. 2 is a prior art electrical schematic for energizing thermal inkjet printheads.

Although there are numerous electrical connections at the connective interface 19 between the pen body 10 and the printhead 11, the present invention influences only four of those connections. With respect to FIGS. 2 and 3, printhead contact 14 joins with pen body contact 24 to service the nozzle heater circuits 40 with a source of electrical power. In the prior art configuration of FIG. 2, the power source contact 14 also serves the substrate heater circuit 36. As shown in FIG. 2, printhead contact 16 joins with pen body contact 26 for an independent ground connection for the prior art heater circuit 36. Printhead contact 18 joins with pen body contact 28 as a ground connection for the nozzle heater circuits 40 and the manufacturing quality test circuit 50. Printhead contact 20 is the voltage contact for a temporary source of electrical power to the resistors 52 in the test circuit 50. The only prior art use of contact 20 is before the printhead 111 is joined with the pen body 10. Consequently, there is no prior art pen body contact for correspondence with the test circuit contact 20.

The substrate heater circuit 36 comprises one or more heat generating conductors such as resistors 38. Energization of the substrate heater resistors 38 is controlled by a switch 48 connected between the contact 26 and ground. The state of the switch 48 is determined by a control signal on the line 47 from an external printer controller.

The numerous parallel heating circuits 40 for "firing" each of the numerous jet nozzles 12 comprise at least one heat generating element such as resistors 42 and a firing control switch 44. The control switch is responsive to a fire control signal 45 generated by a print control computer not shown.

Figure 3:
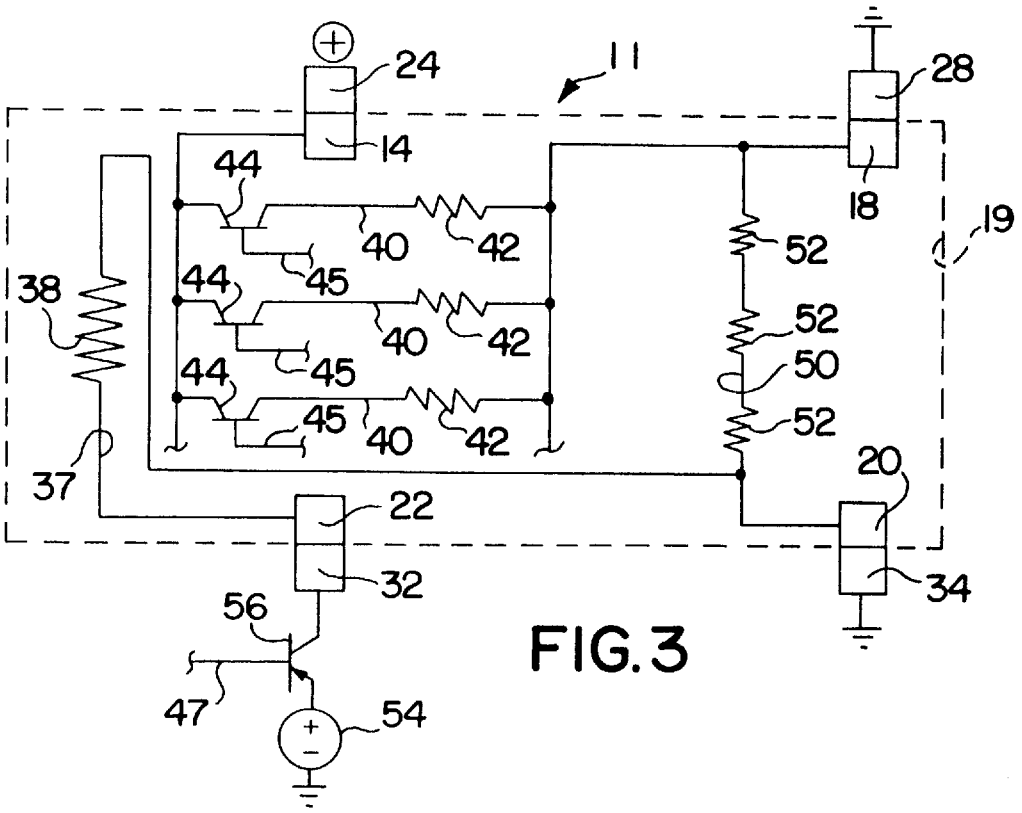
FIG. 3 is an electrical schematic for energizing thermal inkjet printheads according to the present invention.

In contrast to the prior art circuitry of FIG. 2, the invention circuit of FIG. 3 provides for preheating the channel carried ink flow having current continuity between a voltage source contact 22 and a ground contact 20. Coincidentally with the foregoing heater circuit revision, the heater circuit 37 is disconnected from the nozzle heater circuit contact 14. Coordinately, the prior art pen body contact 26 is redirected as a switched voltage source contact 32. Additionally, a grounded pen body contact 34 is provided in the pen body to connect the test circuit contact 20 to ground. According to the preferred embodiment of the invention, a voltage source 54 is provided in the external printer controller to power the heater circuit 37. Whether the voltage source 54 is connected to the contact 32 is determined by the state of the switch 56. The state of the switch 56 is determined by the control signal on the line 47.

It will be understood by those of ordinary skill in the art that, in disconnected isolation from the pen body 10, the manufacturing quality test circuit 50 functions in the same manner as that of the prior art. Although the substrate heater circuit 37 has been connected with the test circuit 50, during manufacturing quality testing the substrate heater circuit 37 is open and inoperative. Consequently, the circuit 37 can have no influence upon the normal operation of the test circuit 50. When functionally combined with the pen body 10, the test circuit 50 is affirmatively grounded at both end terminals 18 and 20, and the substrate heater circuit 37 is connected to the switched voltage source terminal 32.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the invention principles and their practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

What is claimed is:

1. An inkjet printhead comprising:

A plurality of ink discharge nozzles served with an ink supply by respective ink flow conduits, said conduits being formed within a composite substrate;

First electric heater means respective to substantially each of said nozzles to energize ink discharges from a respective nozzle;

Second electric heater means for preheating ink in said conduits;

First circuit means for serving operational voltage to said first heater means, said first circuit means including first voltage connector means and first ground connector means;

Second circuit means for serving operational voltage to a series of electrical resistors having functional purposes substantially limited to verification of the substrate fabrication quality, said second circuit means including second voltage connector means and said first ground connector means; and Third circuit means for serving operational voltage to said second heater means, said third circuit means including third voltage connector means and said second voltage connector means whereby said second voltage connector means is electrically grounded when said printhead is operative.

2. An inkjet printhead as described by claim 1 wherein said second and third connectors are operatively grounded when said first and fourth connectors are electrically charged.

3. An inkjet printhead as described by claim 1 wherein said second electric heater means is a substrate heater.

4. An inkjet printhead as described by claim 1 wherein said second circuit means is non-functional when said first and third voltage connector means are electrically charged.

5. An inkjet printhead as described by claim 1 wherein said first and third circuits are non-functional when said second circuit is electrically charged.

6. An inkjet printhead as described by claim 1 wherein said first circuit means further comprises selectively functioned switch means respective to each of said first electric heater means.

7. An inkjet printhead as described by claim 1 wherein said second circuit means further comprises selectively functioned switch means respective to said second electric heater means.

8. A method of fabricating an inkjet printhead having a plurality of ink discharge nozzles served by ink supply conduits formed within a composite substrate, said ink supply conduits having an ink discharge heater respective to each of said nozzles, said substrate having substrate heater means for heating ink within said conduits prior to said discharge heaters, said substrate further having a first electrical circuit between first and second external connector means for monitoring a manufacturing quality of said printhead, said method of fabrication comprising the steps of:

Providing a second electrical circuit between said first external connector means and a third external connector means for connecting a selectively switched voltage source to the ink discharge heaters; and Providing a third electrical circuit between said second external connector means and a fourth external connector means for selectively connecting a voltage source to the substrate heater means.

9. A method of fabricating an inkjet printhead as described by claim 8 wherein said first and second external connector means are operatively grounded when said third and fourth external connector means are electrically charged.

10. A method of fabricating an inkjet printhead as described by claim 8 wherein said first electrical circuit is non-functional when said second and third electrical circuits are electrically charged.

11. A method of fabricating an inkjet printhead as described by claim 8 wherein said second and third electrical circuits are non-functional when said first electrical circuit is electrically charged.

12. A method of fabricating an inkjet printhead as described by claim 8 wherein said second and third electrical circuits are independently operative.

13. A method of fabricating an inkjet printhead as described by claim 8 wherein said second electric heater means is operative independently of said first electric heater means.

14. A method of fabricating an inkjet printhead as described by claim 8 wherein said first and second electric heater means are selectively operated by computer controlled switching means.

15. A method of fabricating an inkjet printhead as described by claim 8 wherein said first electrical circuit comprises a plurality of resistors connected in series.

* * * * *